United States Patent [19]

Poling

[11] 4,079,347

[45] Mar. 14, 1978

[54] CONTROL DEVICE

[75] Inventor: Ronald W. Poling, Morrison, Ill.

[73] Assignee: General Electric Company, Fort Wayne, Ind.

[21] Appl. No.: 731,699

[22] Filed: Oct. 12, 1976

[51] Int. Cl.[2] ..... H01H 37/36

[52] U.S. Cl. ..... 337/304; 337/305; 337/313

[58] Field of Search ..... 337/301, 302, 303, 304, 337/305, 313; 236/46

[56] References Cited

U.S. PATENT DOCUMENTS

| | | | |
|---|---|---|---|
| 2,150,203 | 3/1939 | Boudurant | 337/319 X |
| 3,019,667 | 2/1962 | Bann | 74/528 |
| 3,244,841 | 4/1966 | Gardes et al. | 337/305 X |
| 3,430,515 | 3/1969 | Lawrence | 74/527 |
| 4,035,752 | 7/1977 | Anderson | 337/304 X |

*Primary Examiner*—George Harris
*Attorney, Agent, or Firm*—Joseph E. Papin

[57] ABSTRACT

A control device adapted to select a set-point temperature for a condition responsive device. The control device has temperature selecting means rotatable through a preselected temperature range generally between a pair of opposite rotated positions, and resilient means is disposed for engagement with a part of the temperature selecting means upon rotation thereof in response to a rotative applied force from one of the opposite rotated positions toward the other thereof so as to arrest the rotation of the temperature selecting means in a predetermined rotated position between the opposite rotated positions. Means is movable in response to another applied force thereon for driving the resilient means toward a displaced position disengaged from the part of the temperature selecting means, and the temperature selecting means is thereafter further rotatable upon further exertion of the rotative applied force thereon from the predetermined rotated position toward the other opposite rotated position. Means is provided on the temperature selecting means for camming engagement with the resilient means so as to maintain the resilient means urged toward its displaced position upon the release of the another applied force on the driving means.

19 Claims, 6 Drawing Figures

CONTROL DEVICE

BACKGROUND OF THE INVENTION

This invention relates generally to control devices and in particular those adapted for use in a condition responsive mechanism to select a set-point temperature therefor.

In some refrigeration systems, such as a room air conditioner or the like for instance, various condition responsive mechanisms are utilized to control the operation of such refrigeration systems. These condition responsive mechanisms generally include switch means for energizing and deenergizing various electrical components of the refrigeration system, and such switch means are actuated by various types of cold controls having a temperature sensor for sensing the temperature of a given space conditioned by the refrigeration system. Of course, these cold controls can be adjusted so as to be operable in response to a selected set-point temperature for the given space as sensed by the temperature sensor of the cold control. In other words, a control device is adjustably associated with the cold control and manually movable through a preselected temperature range to the selected set-point temperature, and such manual movement of the control device, in effect, adjusts or biases the control device so that it actuates the switch means when the temperature sensor senses the set-point temperature in the given space associated with the refrigeration system. Of course, when actuated, the switch means effects the energization of the electrical components of the refrigeration system so as to effect the air conditioning of the given space. One such condition responsive mechanism utilizing the control device to select the set-point temperature therefor is disclosed in U.S. Pat. No. 3,648,214 issued Mar. 7, 1972 to John L. Slonneger.

At least one of the disadvantageous or undesirable features of such past control devices is believed to be that the operator manually moved it to a set-point temperature but could really never ascertain or correlate the amount of energy expended at such selected set-point temperature to effect the cooling or air conditioning of the given space by the refrigeration system. Due to the recently encountered fuel shortages and the analogous power shortages effected thereby, it is, of course, desirable, if not mandatory, to operate a refrigeration system in its most efficient power consuming mode both from an economy point of view and an ecological stand point.

SUMMARY OF THE INVENTION

Among the several objects of the present invention may be noted the provision of an improved control device adapted to select a set-point temperature for a condition responsive mechanism which overcomes the disadvantageous or undesirable features discussed hereinabove, as well as others, with respect to the prior art; the provision of such control device which automatically indicates to the operator the most efficient power consuming or power saving operating mode of a refrigeration system with which such condition responsive mechanism is associated; the provision of such control device in which the operation thereof is inhibited past such power saving operating mode toward higher cooling temperature within a predetermined temperature range in which such control device is operable; and the provision of such control device which is simplistic in design, economically manufactured, easily assembled and which may be readily incorporated with existing components of many such condition responsive mechanisms. These as well as other objects and advantages of the present invention will be in part apparent and in part pointed out hereinafter.

In general and in one form of the invention, a control device adapted to select a set-point temperature for a condition responsive mechanism is provided with temperature selecting means rotatable through a preselected temperature range generally between a pair of opposite rotated positions. Resilient means is disposed for engagement with a part of the temperature selecting means upon rotation thereof in response to a rotative applied force from one of the opposite rotated positions toward the other thereof so as to arrest the rotation of the temperature selecting means in a predetermined rotated position between the opposite rotated positions. Means is movable in response to another applied force thereon for driving the resilient means toward a displaced position disengaged from the part of the temperature selecting means, and the temperature selecting means is thereafter further rotatable upon further exertion of the rotative applied force thereon from the predetermined rotated position toward the other opposite rotated position. Means is provided on the temperature selecting means for camming engagement with at least the resilient means so as to maintain the resilient means urged toward its displaced position upon the release of the another applied force on the driving means.

BRIEF DESCRIPTION OF THE DRAWINGS

Corresponding reference characters indicate corresponding parts throughout the several views of the drawing.

The exemplifications set out herein illustrate the preferred embodiment of the invention in one form thereof, and such exemplifications are not to be construed as limiting in any manner the scope of the invention.

DETAILED DESCRIPTION OF THE PREFERRED EMBODIMENT

Figure 4:
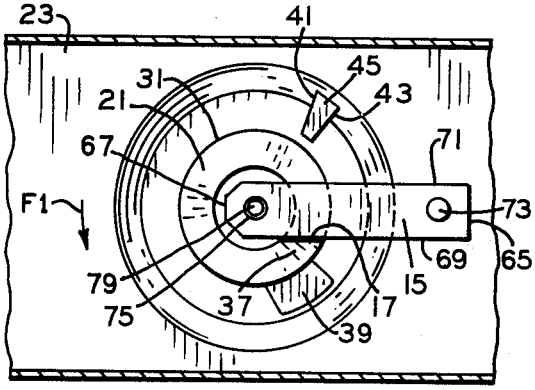
FIGS. 4 and 5 correspond to FIG. 3, respectively, showing the temperature selecting means disposed in a power saver position and a generally cold temperature position thereof, respectively.
Figure 5:
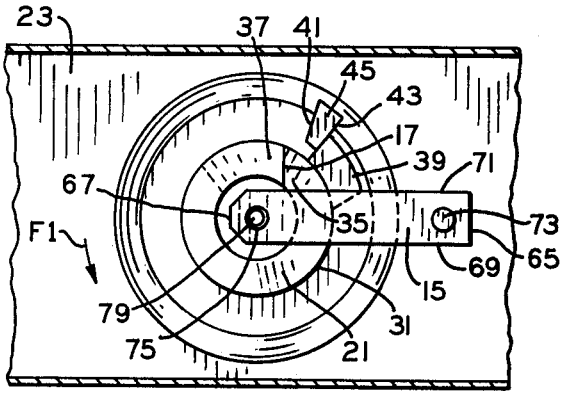
Figure 6:
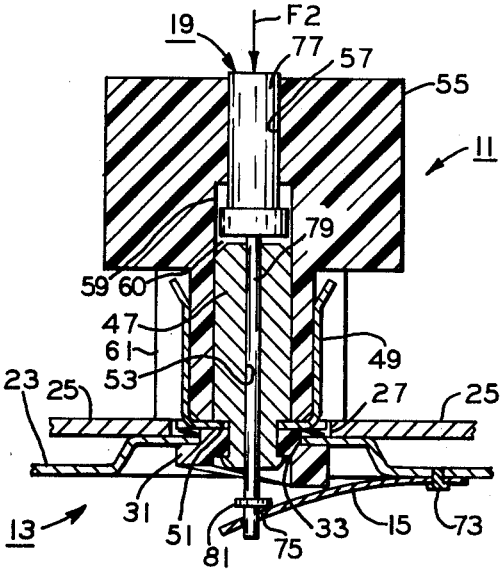
FIG. 6 corresponds generally to FIG. 2 showing a push button of the control device depressed so as to bias a resilient strip away from abutment with the temperature selecting means.

Referring now to the drawings in general, a control device 11 in one form of the invention is adapted to select a set-point temperature for a condition responsive mechanism (not shown), such as for instance that illustrated in the aforementioned U.S. Pat. No. 3,648,214 which is incorporated by reference herein, and if greater detail or construction of such condition responsive mechanism is desired, reference may be had to such patent. Control device 11 has a temperature selecting means, indicated generally at 13, which is rotatable through a predetermined temperature range generally between a pair of opposite rotated positions comprising a warm temperature position and a cold temperature position, respectively (FIGS. 1–3, 5 and 6). A resilient means, such as a strip 15 of spring metal or material for instance, is disposed for engagement with a part, such as an abutment or step 17, of temperature selecting means 13 upon rotation thereof in response to a rotative applied force F1 from one of the opposite rotated positions toward the other thereof so as to arrest the rotation of the temperature selecting means in a predetermined or power saving position between the opposite rotated positions (FIGS. 3 and 4). Means, such as a push button 19, is movable in response to another applied force F2 thereon for driving strip or resilient means 15 toward a displaced position disengaged from step or part 17 of temperature selecting means 13, and the temperature selecting means is thereafter further rotatable upon further exertion of the rotative applied force F1 thereon from the power saving position toward the other opposite rotated position thereof (FIGS. 5 and 6). Means, such as a cam surface 21, is provided on temperature selecting means 13 for camming engagement with at least strip 15 so as to maintain the strip urged toward its displaced position upon the release of applied force F2 on push button or driving means 19 (FIG. 6).

Figure 1:
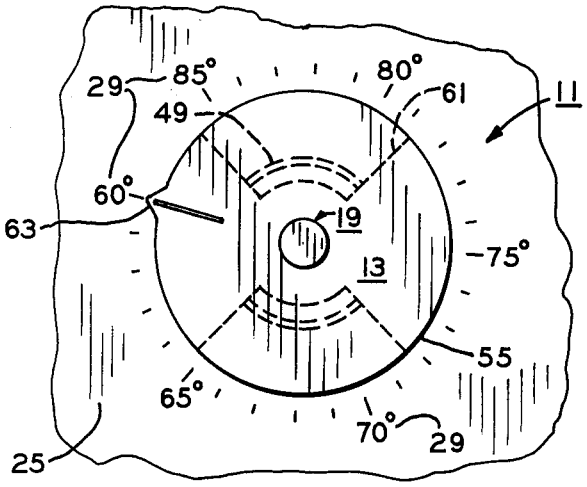
FIG. 1 is a plan view illustrating a control device in one form of the invention mounted to a housing of a condition responsive mechanism.
Figure 2:
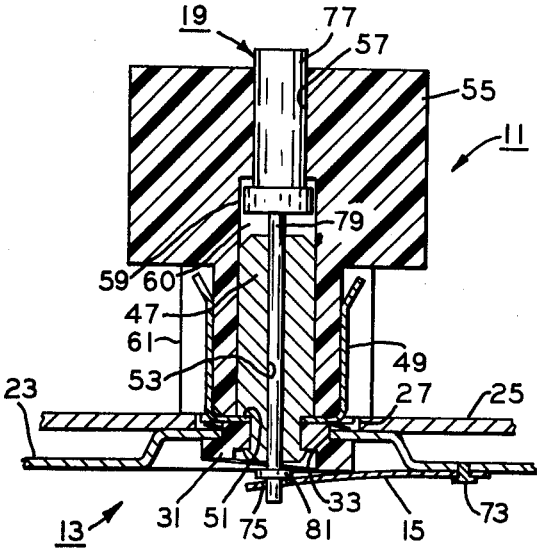
FIG. 2 is a sectional view taken along line 2—2 of FIG. 1 showing a temperature selecting means of the control device disposed in a generally warm temperature position thereof.
Figure 3:
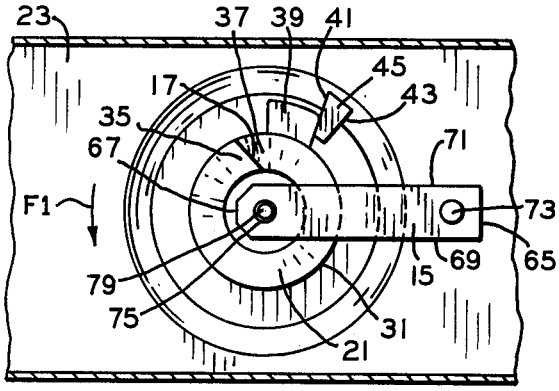
FIG. 3 is a partial sectional view taken along line 3—3 of FIG. 2.

More particularly and with specific reference to FIGS. 1–3, the condition responsive mechanism (not shown) is provided with a casing or housing part 23 which is attached by suitable means well known in the art to a panel 25 such as may be provided in a room air conditioner or the like (not shown), the operation of which is controlled by the condition responsive mechanism, as previously discussed. Panel 25 is provided with an aperture 27 through which control device 11 extends, and temperature indicia, such as that shown at 29 in degrees Fahrenheit for instance, may be provided on the panel generally about the aperture therein and the control device so as to indicate the predetermined temperature range through which temperature selecting means 13 is rotatable or movable.

Temperature selecting means 13 includes a cam or cam member 31 which is rotatably received in an aperture 33 provided through casing 23 of the condition responsive mechanism, and cam surface or camming means 21 is provided on the cam. Cam surface 21 has a predetermined generally spiral rise or configuration between a low portion 35 and a high portion 37 thereof, and step 17 is provided in the cam surface between the low and high portions thereof. Cam 31 is also provided with a flange or abutment means 39 which extends therefrom generally radially with respect to cam surface 21 for abutting or rotation limiting engagement with a pair of opposite sides or surfaces 41, 43 of a stop or abutment 45 integrally formed on casing 23 adjacent the cam. In this manner, the rotation of flange 39 into abutting engagement with opposite sides 41, 43 of stop 45 defines the opposite rotated positions of temperature selecting means 13 as it is rotated through its predetermined temperature range designated by temperature indicia 29 on panel 25.

A stem 47 protrudes through cam 31 generally centrally thereof and is connected with the cam by suitable means, such as swedging or the like, and a finger bracket 49 is seated or clamped between a shoulder 51 on the stem and the cam so that the cam, stem and bracket are conjointly rotatable. Both stem 47 and bracket 49 extend through aperture 27 of panel 25 to the exterior side or portion thereof, and an opening or bore 53 is provided through stem 47 so as to be disposed generally centrally or coaxial with the spiral configuration of cam surface 21. An indicating knob 55 is removably secured between stem 47 and finger bracket 49 with the indicating knob having a pair of stepped bores 57, 59, the larger of the stepped bores 59 being disposed about the stem, and a plurality of flutes 61 are provided on the indicating knob in rotatable driving engagement with the fingers of the finger bracket so as to effect conjoint rotation of cam 21, stem 47 and finger bracket 49 with the indicating knob upon the exertion of rotative applied force F1 thereon. To complete the description of temperature selecting means 13, a pointer or similar sight marking 63 is provided on indicating knob 55 for alignment with the desired set-point temperature when selected within the predetermined range of temperature 29 on panel 25, as discussed hereinafter, and it may be noted that the stepped bores 57, 59 of the indicating knob and the bore 53 of the stem are generally coaxially arranged so as to comprise an opening 60 which extends generally coaxially through the temperature selecting means intersecting with cam 31 thereof generally centrally of cam surface 21.

Strip 15, which is formed from a metal having acceptable resiliency characteristics, is generally elongate and thin having a pair of opposite ends or end portions 65, 67 interconnected between a pair of opposite sides or edges 69, 71, and the strip is disposed at least in part in overlaying relation with cam surface 21 of cam 31. Opposite end 65 of the strips 15 is mounted or otherwise connected by suitable means, such as a rivet 73 for instance, to casing 23 adjacent cam 31, and an opening 75 is provided through the strip adjacent opposite end 67 thereof so that the opening is disposed generally in coaxial alignment with bore 53 of stem 47.

Push button 19 includes a stepped head 77 which is slidably received in stepped bores 57, 59 of indicating knob 55, and the stepped head has a reduced extension 79 which extends through bore 53 of stem 47 and opening 75 of strip 15. A generally radially extending abutment or abutment means 81 is integrally formed on reduced extension 79 of push button 19 adjacent the distal or free end thereof for abutting engagement with strip 15 about opening 75 therein, and the abutment is captured or caged between the strip and the lower end of stem 47 adjacent cam 31. In view of the above, push button 19 extends through openings 60 and 75 in temperature selecting means 13 and strip 15, respectively, and includes a pair of opposite ends comprising stepped head 77 which is exposed beyond indicating knob 55 for receiving applied force F2, as discussed hereinafter, and the distal end of reduced extension 79 on which abutment 81 is formed, respectively. It may also be noted that the resiliency of strip 15 tends to urge abutment 81 on push button 19 upwardly (as best seen in FIG. 2) toward abutment with the lower end of stem 47 and that the engagement of the abutment with both the stem and the strip retains the push button against displacement from opening 60 of temperature selecting means 13.

Assuming that temperature selecting means 13 is disposed in one of its opposite rotated positions with flange 39 of cam 31 engaging side 41 of stop 45 (as best seen in FIG. 3), then pointer 63 of the temperature selecting means indicates a set-point temperature of 85° F. on panel 25 (as best seen in FIG. 1) which is, of course, the generally warm set-point temperature position. In the event it is desired to cool the given space conditioned by the room type air conditioner with which control device 11 is associated, as previously mentioned, an operator exerts rotative applied force F1 on indicating knob 55 so as to effect the conjoint counterclockwise rotation of cam 31 therewith, as indicated by the directional arrow of applied force F1 in FIG. 3. Upon such counterclockwise rotation of cam 31, flange 39 is disengaged from side 41 of stop 45, and step 17 in cam surface 21 is rotated into abutting engagement with cooperating edge 69 of strip 15 which arrests the rotation of temperature selecting means 13 in response to the rotative applied force F1 thereon, as best seen in FIG. 4. With cam step 17 engaging strip edge 69, temperature selecting means 13 is disposed in its power saving position which is generally correlative with the most economical set-point temperature at which the room air conditioner can be operated, and it may be noted that the arrested movement of the temperature selecting means effected by the engagement of the cam step with the strip edge provides a positive "feel" or indication to the operator that the power saver position has been attained.

In the event the operator wishes to rotate temperature selecting means 13 past the power saver position toward the colder temperature position thereof in order to effect a cooler set-point temperature, the operator must exert applied force F2 on the exposed head 77 of push button 19 (as best seen in FIG. 6). In response to the exertion of applied force F2 thereon, push button 19 is depressed so as to be vertically movable through opening 60 in temperature selecting means 13 against the opposing resilient force of strip 15. In this manner, the depression of push button 19 in response to applied force F2 acting thereon effects the deflection or pivotal movement of strip 15 toward a displaced position spaced away from cam 13 so as to disengage edge 69 of the strip from step 17 of cam surface 21. Subsequent to this disengagement of strip edge 69 from cam step 17, the operator may further exert rotative applied force F1 on temperature selecting means 13 to further effect the rotative movement thereof past the power saver position toward a cold temperature position or temperature setting until flange 39 of cam 31 engages side 43 of stop 45. Of course, once cam step 17 passes beneath strip edge 69 when strip 15 is urged toward its displaced position by push button 19 in response to applied force F2 acting thereon, the applied force F2 may be released from the push button, and the resilient force of the strip will urge it into camming engagement with high portion 37 of cam surface 21. In this manner, the camming engagement of cam surface 21 with strip 15 tends to maintain the strip deflected or urged toward its displacement position.

In the event the operator now desires to return temperature selecting means 13 from the cold temperature position to the warm temperature position thereof, the operator exerts rotative force F1 on indicating knob 55 so as to conjointly rotate cam 31 therewith in the clockwise direction, i.e. opposite to the directional arrow of rotative applied force F1, until the desired set-point temperature is attained or until flange 39 is returned into abutting engagement with side 41 of stop 45 (as best seen in FIG. 3). Upon the clockwise or return movement of temperature selecting means 13 to its warm temperature position, it may be noted that edges 69, 71 ride over step 17 of cam surface 21 so that abutment therebetween is obviated thereby to enhance the return or clockwise rotative movement of the temperature selecting means past its power saver position.

Of course, further counterclockwise and clockwise rotation of temperature selecting means 13, as discussed above, may be effected to subsequently select other set-point temperatures for the operation of the air conditioner with which control device is associated. A control or adjusting arm or lever for the cold control of the condition responsive mechanism (not shown) is intended to be disposed in camming engagement with cam surface 21 of cam 31 so as to adjust the set-point temperature sensed by the condition responsive mechanism in the given space with which the room air conditioner is associated.

From the foregoing, it is apparent that a novel control device 13 has been presented meeting the objects and advantages set out herein, as well as others, and it is contemplated that changes as to the precise arrangements, shapes and details of the component parts of the control device may be made by those having ordinary skill in the art without departing from the spirit of the invention or the scope thereof as set out in the claims which follow.

What I claim as new and desire to secure by Letters Patent of the United States is:

1. A control device mounted to a housing of a condition responsive mechanism and adapted to select a set-point temperature for the condition responsive mechanism, the control device comprising temperature selecting means supported in the housing for manual rotation through a predetermined temperature range so as to select the set-point temperature, said temperature selecting means including a cam conjointly rotatable with said temperature selecting means, a cam surface on said cam having a predetermined generally spiral rise between a low portion and a high portion thereof, a step in said cam surface between said low portion and said high portion thereof, a flange on said cam extending generally radially thereof with respect to said cam surface, and a first opening extending generally coaxially through said temperature selecting means and intersecting with said cam generally centrally of said cam surface thereof; a stop on the housing for engagement with said flange so as to define a pair of opposite rotated positions of said cam; a strip of resilient material disposed at least in part in overlaying relation with said cam surface, said strip including a pair of opposite end portions, one of said opposite end portions of said strip being mounted to the housing adjacent said cam, a second opening in said strip adjacent the other of said opposite end portions thereof and disposed generally in aligned relation with said first opening, and an edge on said strip intermediate said opposite end portions thereof for abutting engagement with said step, said cam being initially rotatable in response to an applied rotative force on said temperature selecting means to displace said flange from one of the opposite rotated positions of said cam in abutment with said stop and move said step into abutting engagement with said edge of said strip so as to arrest the rotatable movement of said temperature selecting means in response to the rotative applied force; and a push button extending through said first and second openings and including a pair of opposite ends, one of said opposite ends being exposed beyond said temperature selecting means for receiving another applied force, and an abutment adjacent the other of said opposite ends disposed between said cam and said strip and engaged with said strip, said push button being movable in said first opening with respect to said temperature selecting means in response to the another applied force on said one opposite end so as to bias said strip in one direction generally away from said cam surface and disengage said edge of said strip from abutting engagement with said step and said temperature selecting means being thereafter further rotatable upon further exertion of the rotative applied force thereon so as to further rotate said cam toward the other of said opposed rotated positions and pass said strip past said edge of said strip.

2. A control device adapted to select a set-point temperature for a condition responsive mechanism, the control device comprising temperature selecting means rotatable through a preselected temperature range generally between a pair of opposite rotated positions; resilient means for engagement with a part of said temperature selecting means upon rotation thereof in response to a rotative applied force from one of the opposite rotated positions toward the other thereof so as to arrest the rotation of said temperature selecting means in a predetermined rotated position between the opposite rotated positions; means movable in response to another applied force thereon for driving said resilient means toward a displaced position disengaged from said part of said temperature selecting means and said temperature selecting means being thereafter further rotatable upon further exertion of the rotative applied force thereon from the predetermined rotated position toward the other opposite rotated position; and means on said temperature selecting means for camming engagement with at least said resilient means so as to maintain said resilient means urged toward its displaced position upon the release of the another applied force on said driving means, said camming engagement means including said part of said temperature selecting means.

3. A control device as set forth in claim 2 wherein said camming engagement means include means for abutting engagement with said resilient means when said temperature selecting means is rotated to the predetermined rotated position.

4. A control device as set forth in claim 3 wherein said resilient means include means for seating said abutting engagement means so as to arrest the rotative movement of said temperature selecting means in the predetermined rotated position.

5. A control device as set forth in claim 2 wherein said camming engagement means includes a cam surface having a generally spiral rise between a low portion and a high portion thereof, said high portion being disposed for the camming engagement with said resilient means upon the rotation of said temperature selecting means from its predetermined rotated position toward the other opposite rotated position thereof.

6. A control device as set forth in claim 5 wherein said cam surface includes a step between said low portion and said high portion, said step being disposed in abutment with said resilient means when said temperature selecting means is in the predetermined rotated position, said step comprising said part of said temperature selecting means.

7. A control device as set forth in claim 2 wherein said resilient means comprises a strip disposed at least in part in overlaying relation with said camming engagement means.

8. A control device as set forth in claim 7 wherein said strip includes an edge engageable with said part of said temperature selecting means in the predetermined rotated position thereof.

9. A control device adapted to select a set-point temperature for a condition responsive mechanism, the control device comprising temperature selecting means rotatable between a pair of opposite rotated positions for selecting the set-point temperature, said temperature selecting means including a cam surface, and a step in said cam surface; resilient means extending adjacent said cam surface for abutting engagement with said step, said temperature selecting means being initially rotatable from one of the opposite rotated positions in response to a rotative applied force thereon so as to move said step into abutting engagement with said resilient means and thereby arrest the rotation of said temperature selecting means; and means reciprocally movable within said temperature selecting means for displacing said resilient means, said displacing means being movable in response to another applied force thereon to displace said resilient means from its abutting engagement with said step and said temperature selecting means being thereafter further rotatable upon the further exertion of the rotative applied force toward the other of the opposite rotated positions thereof.

10. A control device as set forth in claim 9 wherein said resilient means comprises a generally elongate strip disposed at least in part in overlaying relation with said cam surface.

11. A control device as set forth in claim 10 wherein said strip includes an edge portion for the abutting engagement with said step.

12. A control device as set forth in claim 10 wherein said strip includes a pair of opposite end portions, one of said opposite end portions being connected with a part of the condition responsive mechanism generally adjacent said cam surface and the other of said opposite end portions being disposed adjacent said displacing means for abutment therewith.

13. A control device as set forth in claim 9 wherein said temperature selecting means includes an opening extending generally coaxially therethrough, said displacing means being movable in said opening.

14. A control device as set forth in claim 13 wherein said displacing means includes means for abutment with both the temperature selecting means and the resilient means to maintain said displacing means against displacement from said opening.

15. A control device as set forth in claim 9 wherein said cam surface includes a generally spiral rise between a low portion and a high portion thereof, said step being disposed between said low portion and said high portion.

16. A control device as set forth in claim 15 wherein said displacing means includes an extension extending through said temperature selecting means generally centrally of said cam surface and adapted for abutment with said resilient means to effect its displacement upon the another applied force movement of the displacing means.

17. A control device as set forth in claim 16 wherein said resilient means includes an opening therethrough, said extension protruding through said opening, and an abutment on said extension adapted for engagement with said resilient means generally about said opening upon the another applied force movement of said displacing means to effect the displacement of said resilient means from its abutting engagement with said step.

18. A control device adapted to select a set-point temperature for a condition responsive mechanism, the control device comprising temperature selecting means rotatable between a generally warm temperature position and a generally cold temperature position with a power saver position therebetween; abutment means on said temperature selecting means; means resiliently urged toward said temperature selecting means for indicating the power saver position thereof; said temperature selecting means being initially rotatable in response to an applied force thereon from the warm temperature position to move said abutment means into abutting engagement with said indicating means thereby to arrest the rotative movement of said temperature selecting means in the power saver position; means reciprocally movable in said temperature selecting means and disposed generally coaxially therewith for driving said indicating means toward a position displaced from said temperature selecting means, said driving means being movable in response to another applied force thereon with respect to said temperature selecting means in the power saver position to resiliently urge said indicating means toward its displaced position disengaged from said abutment means and said temperature selecting means being thereafter further rotatable in response to the first named applied force from the power saver position to the cold temperature position thereof; and means on said temperature selecting means for engagement with said indicating means to maintain it urged toward the displaced position during at least a part of the rotative movement of said temperature selecting means from the power saver position toward the cold temperature position upon the release of the another applied force from said driving means.

19. A control device adapted to extend through an aperture in a housing therefor, the control device comprising a generally annular cam rotatably engaged with one side of the housing generally about the aperture therein; a generally spiral cam surface on said cam having a step therein; an elongate generally cylindric stem connected with said cam and extending through the aperture generally away from the other side of the housing; a shoulder on said stem; a bracket clamped between said shoulder and said cam including a plurality of fingers spaced generally radially of said stem and disposed generally coaxially therewith; a knob including a portion extending about said stem and releasably engaged with said fingers, and a plurality of flutes on said knob portion extending generally radially thereof between said fingers in abutting engagement therewith; an opening extending generally coaxially through said knob and said stem and disposed generally centrally of said cam surface; a resilient strip pivotally mounted to the housing and disposed at least in part in overlaying relation with said cam surface and said opening, said cam being initially rotatable in response to a rotative applied force on said knob to move said step into abutting engagement with said strip thereby to arrest the rotative movement of said cam; a push button reciprocally movable in said opening including an extension protruding from said opening and adapted for abutting engagement with said at least part of said strip, said push button being depressed in response to another applied force exerted thereon so as to pivotally urge said resilient strip toward a position displaced from said step and said cam being thereafter further rotatable in response to the further exertion of the rotative applied force on said knob to move said step past said resilient strip when it is urged toward its displaced position by said push button.

* * * * *